US005461836A

United States Patent [19]

Yang

[11] Patent Number: 5,461,836

[45] Date of Patent: Oct. 31, 1995

[54] STRUCTURE OF SKID-PROOF PLATE FOR STAIRS

[76] Inventor: Shan T. Yang, No. 87-1, Jeng-Yih S. Rd., San Chung City, Taipei Hsien, Taiwan

[21] Appl. No.: 231,579

[22] Filed: Apr. 22, 1994

[51] Int. Cl.[6] ..... E04F 11/09

[52] U.S. Cl. ..... 52/179; 52/181; 52/312; 52/716.1; 52/716.4; 52/716.6; 52/718.01; 52/718.04

[58] Field of Search ..... 52/179, 181, 177, 52/716.1, 716.4, 716.6, 718.01, 718.04, 312

[56] References Cited

U.S. PATENT DOCUMENTS 2,288,470 6/1942 Lorraine ..... 52/179
3,334,456 8/1967 Naka ..... 52/179
4,066,285 1/1978 Hall et al. ..... 52/716.6 X
4,905,431 3/1990 Davis ..... 52/179

*Primary Examiner*—Carl D. Friedman
*Assistant Examiner*—Christopher Todd Kent
*Attorney, Agent, or Firm*—Pro-Techtor International

[57] ABSTRACT

The structure is composed of a base plate, a skid-proof embedding strip and one or two end embedding strips; whereon the base plate is made of copper or aluminum and is extruded to form an elongated strip, an elastic skid-proof embedding strip can be fitted therein and is fixed at one or both sides of the strip by one or two end embedding strips, such structure suits the noble marble, granite, wood block surfaces of stairs, which structure has the advantages of easy assembling, easy exchanging, changeable of its color according to the changing of seasons, and having excellent skid-proof effect.

3 Claims, 3 Drawing Sheets

STRUCTURE OF SKID-PROOF PLATE FOR STAIRS

BACKGROUND OF THE INVENTION

1. Field of the Invention

The present invention relates to a structure of skid-proof plate for stairs, and especially to one which is composed of a base plate, a skid-proof embedding strip and one or two end embedding strips, and which can provide an excellent skid-proof and safe effect.

2. Description of the Prior Art

Nowadays, buildings are standing everywhere, over-line bridges and underpasses locate at many places that we may pass through, hence we have a lot of chances to walk up and down stairs or steps, while these stairs and steps are traditionally designed to have on every step a simple copper strip, aluminum strip or plastic strip for preventing pedestrians from slipping. However, such structure is simply a single material, yet the upper surface thereof is smooth, the skid-proof effect thereof thus is poor, and once a skid-proof strip of some material or some color is embeded in a step, it can not be changed; besides, stairs in a modern house or building mostly use elegant marble, granite or wood blocks of high classes as their material, they don't have any design of a skid-proof structure or they just are treated by sandblasting, not only the construction work is difficult, but also the damage by rubbing goes fast and not easy to repair, a good skid-proof effect thus is not able to achieve.

SUMMARY OF THE INVENTION

In view of this, an object of the present invention is to provide a structure of skid-proof plate of a novel design, this structure is composed of a base plate, a skid-proof embedding strip and one or two end embedding strips, and is suitable to be mounted on a marble, granite or wood block stairs, it is easy for fixation, simple for changing, and can have an excellent skid-proof effect.

The present invention will be apparent after reading the detailed description of the preferred embodiment thereof in reference to the accompanying drawings.

DETAILED DESCRIPTION OF THE PREFERRED EMBODIMENT

Figure 1:
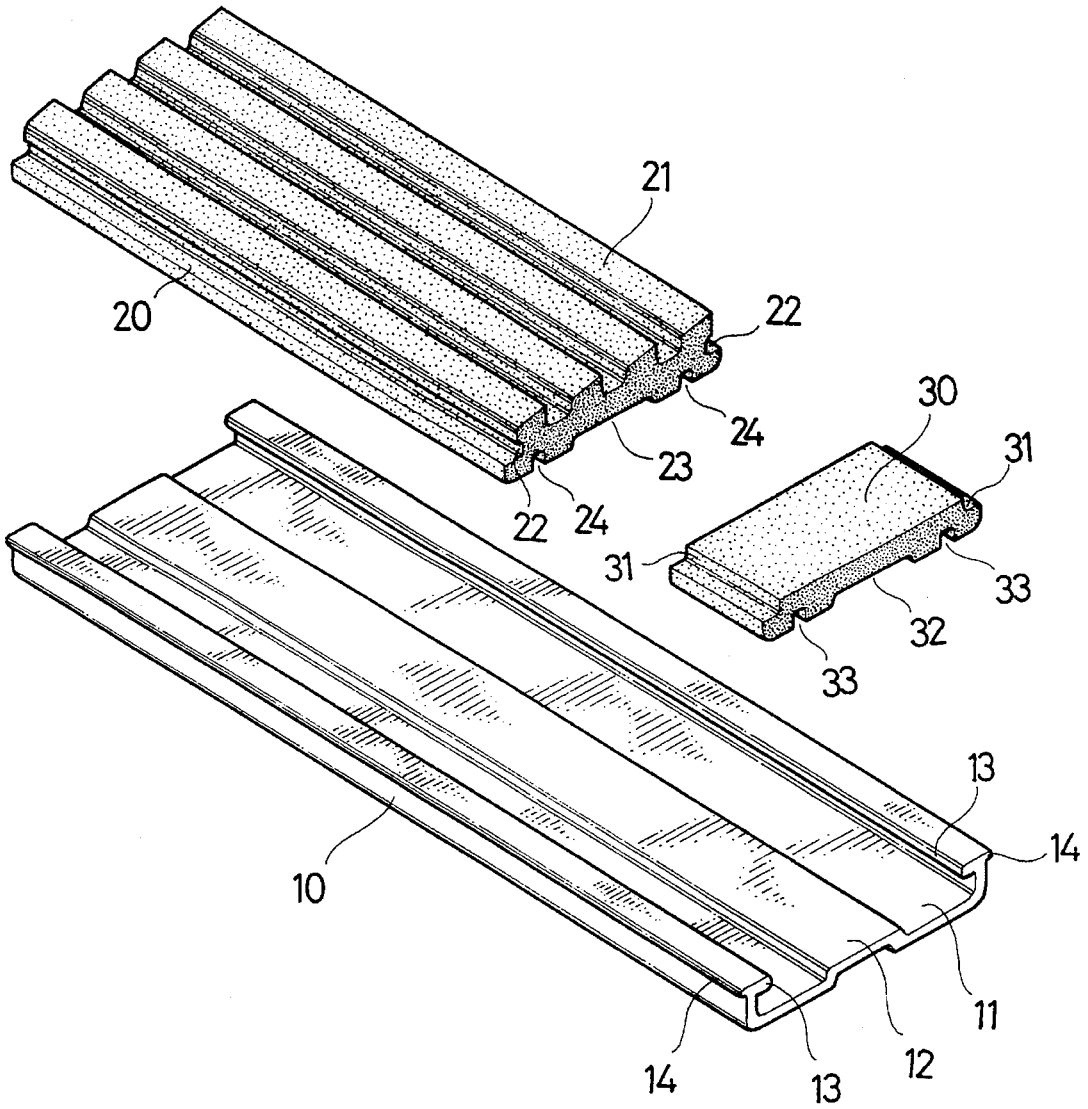
FIG. 1 is an anatomic schematic view of the present invention.

Referring to FIG. 1, the present invention is composed of a base plate 10, a skid-proof embedding strip 20 and one or two end embedding strips 30, wherein the base plate 10: is made of copper or aluminum and is extruded to form an elongated strip; two concave embedding seats 11, a central convex portion 12, and two inwardly protruding flanges 13 and outwardly protruding flanges 14 on both sides.

the skid-proof embedding strip 20: is made of abrasion resistant plastic material, a plurality of protruding ribs 21 with their top surfaces slightly declined forwardly are provided on the top thereof, on both sides thereof each has a groove 22, and on the bottom thereof is a central groove 23 and two flexing grooves 24 each being near one side thereof.

the end embedding strips 30: are also made of abrasion resistant plastic material, the top surface thereof is even, two embedding grooves 31 each is provided on one side thereof, there is also a bottom central groove 32 and two flexing grooves 33 each being on one side thereof.

Figure 2:
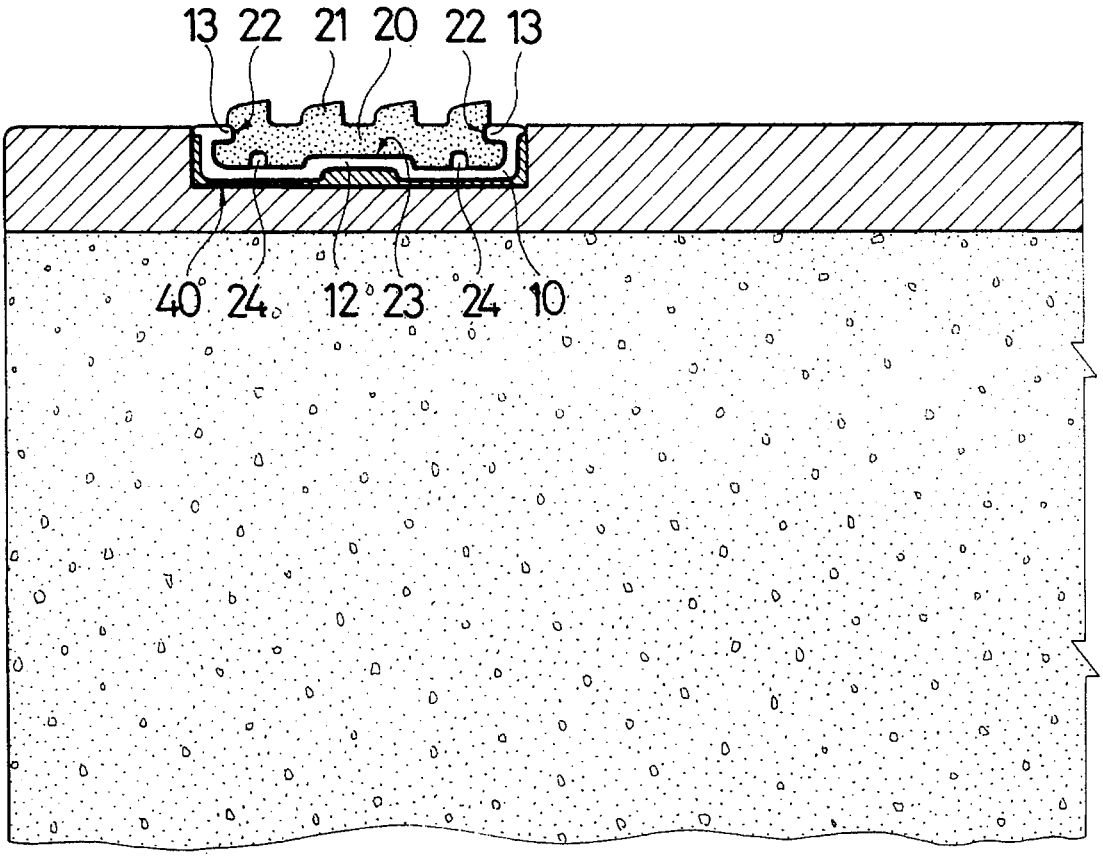
FIG. 2 is a sectional schematic view of the assembled embodiment of the present invention showing the relationship of position among a skid-proof embedding strip, a base plate and a step.
Figure 3:
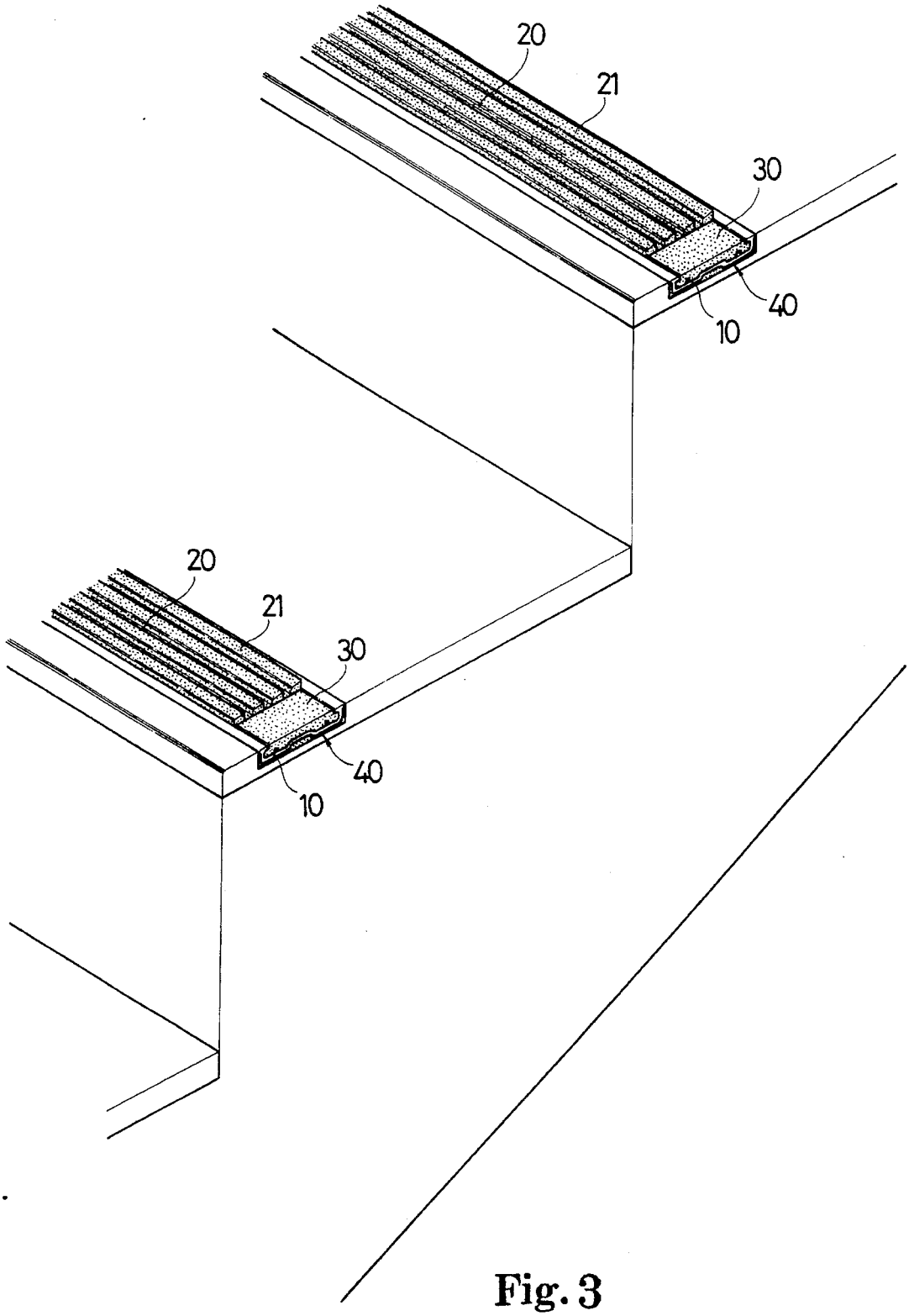
FIG. 3 is a schematic view of the assembled embodiment of the present invention showing the relationship of position among a plurality of skid-proof embedding strips, base plates, end embedding strip and steps.

With such a structure, the construction work of the present invention goes as following: firstly, the marble, granite or wood block top surface of the stairs is cut by milling with a seating groove 40 as shown in FIG. 2, the base plate 10 of the present invention is firmly adhered to the seating groove 40 with strong adhesive, then the skid-proof embedding strip 20 is pressed and fitted into the embedding seat 11 of the base plate 10 by the compressible nature of the two flexing groove 24 on the bottom of the strip 20. When embedded, each inner protruding strips 13 is exactly embedded in one groove 22, while the convex portion 12 is exactly embedded in the central groove 23, so that the skid-proof embedding strip 20 is firmly fixed in the base plate 10. And for the sake of sweeping of the stairs on ordinary days, one or two end embedding strips 30 having flat top surfaces, as shown in FIG. 3, after the end embedding strips 30 are embedded in the concave embeding seats 11, the inner protruding strips 13 embed in the embedding grooves 31, and the convex portions 12 are also embedded in the bottom central grooves 32 to allow them to be firmly held in positions. In this way, the dust deposited between each protruding rib 21 of the skid-proof embedding strip 20 can be swept transversely to the top flat surfaces of the end embedding strips 30 and then be swept out orthogonally, this is thus a thoughfull design. The skid-proof embedding strip 20 is made of plastic having good frictional resistance to prevent skidding, while the protruding ribs 21 thereon have their top surfaces designed to be slightly declined forwardly, so that a pedestrian will be aided to raise himself/herself by frictional resistance when he/she goes up stairs, and obtains a skid-proofing action and his/her feet will feel comfortable in stepping by the decline surfaces when he/she goes down stairs.

the skid-proof embedding strip 20 and the end embedding strips 30 of the present invention can fit in the base plate 10 due to the compressibility of the flexing grooves 24,33, and can be removed to change for the new skid-proof embedding strip 20 and the new end embedding strips 30 with other colors according to the tone of the environment or to the changing of the seasons.

The novel structure of the present invention not only gets rid of the defects resided in the conventional skid-proof structure for stairs, but also provides an excellent and practical structure suitable for the noble marble, granite, wood block surfaces of stairs, which structure has the advantages of easy assembling, easy exchanging, removable for washing or for changing, capable of selecting various colors, and having excellent skid-proof effect.

My invention may assume numerous forms and is to be construed as including all modifications and variations falling within the scope of the appended claims.

What is claimed is:

1. A skid-proof plate structure for stairs, comprising:

a base plate made of metal, said base plate being extruded to form an elongated strip, said base plate including two concave embedding seats, a central convex portion, and a strip with an inwardly protruding flange and an outwardly protruding flange on each side of said base plate;

a skid-proof embedding strip made of abrasion resistant plastic material, said embedding strip including a plurality of protruding ribs, a top surface of each of said ribs being angled toward a front side of said embedding strip, said front side of said embedding strip and a rear side of said embedding strip each includes a groove, and a bottom side of said embedding strip includes a central groove and two flexing grooves, said flexing grooves being located near the front and rear sides of the embedding strip, said flexing grooves being received in said concave embedding seats, and said inwardly protruding flanges of said base plate being received in said grooves in said front side and said rear side of said embedding strip, and said central convex portion being received in said central groove on said bottom of said embedding strip;

end embedding strips made of abrasion resistant plastic material, said front side of each of said embedding strips and said rear side of each of said embedding strips each includes a groove, said grooves receiving said inwardly protruding flanges of said base plate, a bottom surface of said end embedding strips has a conformation equivalent to that of said embedding strip so that said end embedding strips are received in said base plate.

2. The plate structure as claimed in claim 1 wherein:

said base plate is made of copper.

3. The plate structure as claimed in claim 1 wherein:

said base plate is made of aluminum.

* * * * *